US011852107B2

(12) United States Patent
Tanida et al.

(10) Patent No.: US 11,852,107 B2
(45) Date of Patent: Dec. 26, 2023

(54) LEAKAGE DETECTOR FOR FUEL VAPOR TREATMENT SYSTEM

(71) Applicant: AISAN KOGYO KABUSHIKI KAISHA, Obu (JP)

(72) Inventors: Yuya Tanida, Obu (JP); Mariko Kawase, Funabashi (JP)

(73) Assignee: AISAN KOGYO KABUSHIKI KAISHA, Obu (JP)

( * ) Notice: Subject to any disclaimer, the term of this patent is extended or adjusted under 35 U.S.C. 154(b) by 84 days.

(21) Appl. No.: 17/741,714

(22) Filed: May 11, 2022

(65) Prior Publication Data

US 2022/0389889 A1 Dec. 8, 2022

(30) Foreign Application Priority Data

Jun. 2, 2021 (JP) ..... 2021-092905

(51) Int. Cl.
*F02M 25/08* (2006.01)

(52) U.S. Cl.
CPC ..... *F02M 25/0818* (2013.01)

(58) Field of Classification Search
CPC ..... F02M 25/0818; F02M 25/0809
See application file for complete search history.

(56) References Cited

U.S. PATENT DOCUMENTS 8,683,852 B2 * 4/2014 Makino ..... F02M 25/0836 123/518
8,713,994 B2 * 5/2014 Makino ..... F02M 25/0836 73/49.3
10,718,281 B2 * 7/2020 Akita ..... F02M 35/0218
11,326,559 B2 * 5/2022 Nakagawa ..... F02M 25/0836
2011/0308302 A1 * 12/2011 Makino ..... F02M 25/0836 73/40.7
2020/0217276 A1 * 7/2020 Nakagawa ..... G01M 3/3209
2023/0043915 A1 * 2/2023 Tanida ..... G01M 3/3209

FOREIGN PATENT DOCUMENTS

JP 2012002138 A 1/2012
JP 2015075032 A 4/2015
JP 2019019761 A 2/2019

* cited by examiner

*Primary Examiner* — Freddie Kirkland, III
(74) *Attorney, Agent, or Firm* — CONLEY ROSE, P.C.

(57) ABSTRACT

A leakage detector includes a pressure sensor for detecting the pressure in a detecting target area of the fuel vapor treatment system and a controller. The controller measures the pressure in the detecting target area at a certain point in time. The controller then determines whether the measured pressure satisfies a condition for leakage detection by a vapor pressure device. When the controller determines that the condition is satisfied, the controller selects the vapor pressure device. When the controller determines that the condition is not satisfied, the controller predicts the change in vapor pressure at a subsequent temperature based on a saturated vapor pressure characteristic of the fuel. If it is determined the pressure in the detecting target will satisfy a predetermined condition, the controller selects a pressure application device. If it is determined that the predetermined condition will be satisfied, the controller selects the vapor pressure device.

11 Claims, 4 Drawing Sheets

LEAKAGE DETECTOR FOR FUEL VAPOR TREATMENT SYSTEM

CROSS-REFERENCE TO RELATED APPLICATIONS

This application claims priority to Japanese patent application serial number 2021-092905, filed Jun. 2, 2021, the contents of which is hereby incorporated herein by reference in its entirety for all purposes.

BACKGROUND

This disclosure relates generally to leakage detectors for fuel vapor treatment systems.

A vehicle utilizing fuel, such as gasoline, is often equipped with a fuel vapor treatment system that captures fuel vapor generated in a fuel tank by adsorbing the fuel vapor in a canister. The fuel vapor treatment system purges the fuel vapor captured in the canister when the engine of the vehicle is running. Some fuel vapor treatment systems are equipped with a leakage detector that automatically determines the presence or absence of leakage in a fuel tank, a canister, and/or a detecting target area around them.

Leakage detecting methods may be roughly classified into vapor pressure methods and pressure application methods. The vapor pressure methods are performed when the total pressure in the system, including the vapor pressure naturally existing in fuel, is sufficiently positive or negative, as described below. The pressure application methods are performed by forcibly introducing a positive pressure or negative pressure into a detecting target area. In both methods, a valve is closed to confine the detecting target area, and the subsequent change in pressure in the system is used to detect a leakage (a hole). One leakage detector is configured to first try the vapor pressure method and then switch to the pressure application method if the detection fails.

SUMMARY

In accordance with an aspect of the present disclosure, a leakage detector, which detects a leakage of fuel vapor from a fuel vapor treatment system including a fuel tank, may comprise a pressure sensor for detecting the pressure in a detecting target area of the fuel vapor treatment system and a controller. The controller is configured to measure the pressure in the detecting target area at a certain point in time using the pressure sensor. Then, the controller is configured to determine whether the measured pressure in the detecting target area satisfies a first predetermined condition for leakage detection by a first method that does not involve forced pressure application. When the controller determines that the first predetermined condition is satisfied, the controller is configured to determine that the leakage detection by the first method should be performed. When the controller determines that the first predetermined condition is not satisfied, the controller is configured to predict a change in vapor pressure in the detecting target area due to a subsequent temperature change based on a saturated vapor pressure characteristic of the fuel in the fuel tank. When it is determined that the pressure in the detecting target area would not continuously satisfy the first predetermined condition based on the predicted change in vapor pressure, the controller is configured to perform the leakage detection by a second method that involves a forced pressure application. When it is determined that the pressure in the detecting target area would satisfy the first predetermined condition, the controller is configured to determine that the leakage detection by the first method should be performed. According to the above aspect, the detection method may be determined before actually trying a leakage detection method. Therefore, it is possible to reduce the power consumption for the leakage detection and increase the number of times the leakage detection could be performed.

DETAILED DESCRIPTION

With a detector that always detects leakage using the pressure application method, there is a problem of high power consumption due to the need to operate a pump or other means of applying pressure. On the other hand, the vapor pressure leakage detector always tries the leakage detection by the vapor pressure method at least once, and thus, it takes time to perform a detection. Thus, it is often impossible to make a detection when the parking time is short. As a result, it is difficult to increase the number and frequency of leakage detections. Therefore, it is desired to reduce the power consumption required for the leakage detection of the fuel vapor treatment system and to improve the number of times the leakage detection can be performed.

Now, various embodiments will be described below with reference to the figures.

Figure 1:
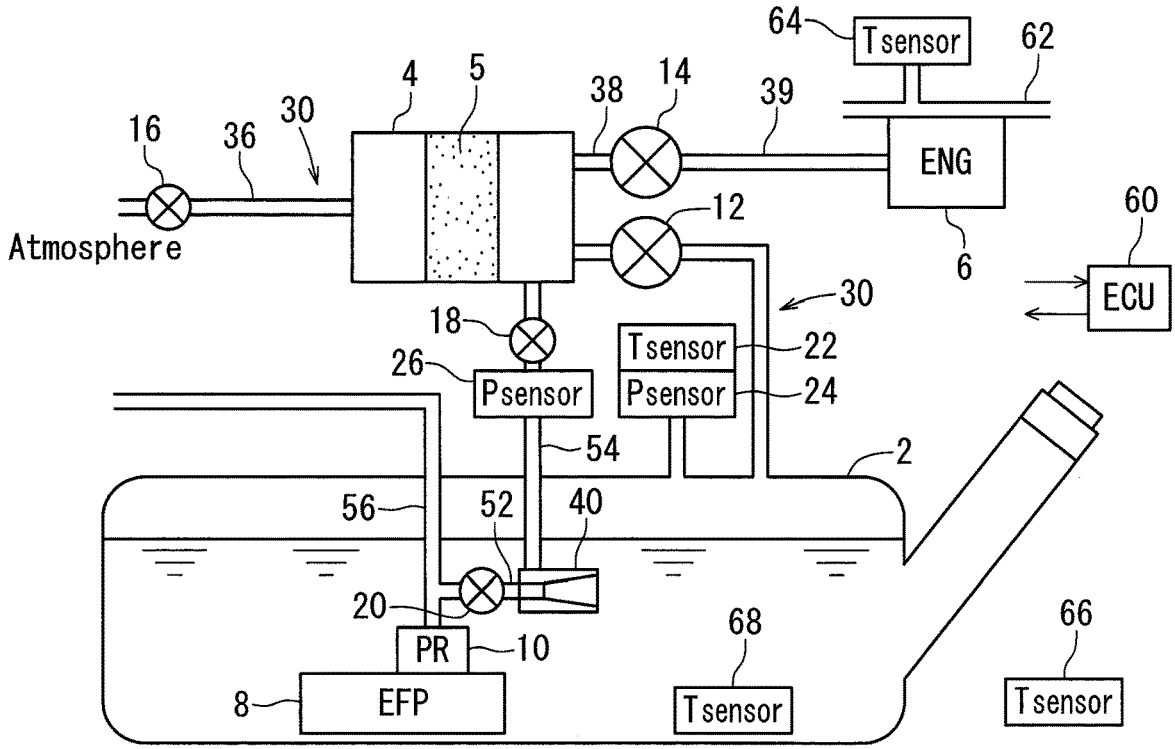
FIG. 1 is a schematic view of an embodiment of a fuel vapor treatment system and a leakage detector in accordance with the principles described herein.

FIG. 1 shows an embodiment of a fuel vapor treatment system and a leakage detector. The fuel vapor treatment system and the leakage detector may be installed in a vehicle equipped with a gasoline engine, diesel engine, or other engine. A vapor passage is connected to a tank port of a canister 4 so as to provide selective fluid communication between the gas-phase in a fuel tank 2 and the canister 4. An atmospheric passage 36, one end of which is opened to the atmosphere via an atmospheric valve 16, is connected to the atmospheric port of the canister 4. The fuel vapor, which has evaporated into the gas-phase in the fuel tank 2, flows into the canister 4 via the vapor passage. The fuel vapor is then adsorbed and captured by an adsorption layer 5 in the canister 4. The adsorption layer 5 may contain activated carbon and other materials. A sealing valve 12 is provided along the vapor passage to selective open and close the vapor passage. Therefore, in a state where the sealing valve 12 and the atmospheric valve 16 are open, the fuel vapor in the fuel tank 2 flows into the canister 4 when the pressure of the fuel vapor in the fuel tank 2 becomes relatively high. Then, the fuel vapor is adsorbed and captured by the adsorption layer 5 in the canister 4. A purge passage is connected to a purge port of the canister 4 so as to provide selective fluid communication between the tank side of the canister 4 and the engine 6. One end of a canister-side portion 38 of the purge passage is in communication with a downstream-side portion 39 of the purge passage via a purge valve 14. The other end of the downstream-side portion 39 of the purge passage is in communication with the intake passage of the engine 6. Thus, in a state where the engine 6 is operated and the purge valve 14 and the atmospheric valve 16 are open, the fuel vapor, which had previously been adsorbed and captured by the canister 4, is sucked by the intake negative pressure of the engine 6. Then, the sucked fuel vapor is burned in the engine 6.

A fuel pump 8 is fixed on the bottom of the fuel tank 2. The fuel pump 8 supplies fuel in the fuel tank 2 to the engine 6 via a fuel supply passage 56. A pressure regulator 10 is generally provided downstream of the fuel pump 8. The pressure regulator 10 regulates the pressure of the fuel to be supplied from the fuel pump 8 to the engine 6. This may be accomplished by returning excess fuel to the fuel tank 2. The fuel tank 2 is provided with a temperature sensor 22 and a pressure sensor 24 that detect the temperature and pressure of the gas-phase of the fuel tank 2, respectively.

Figure 3:
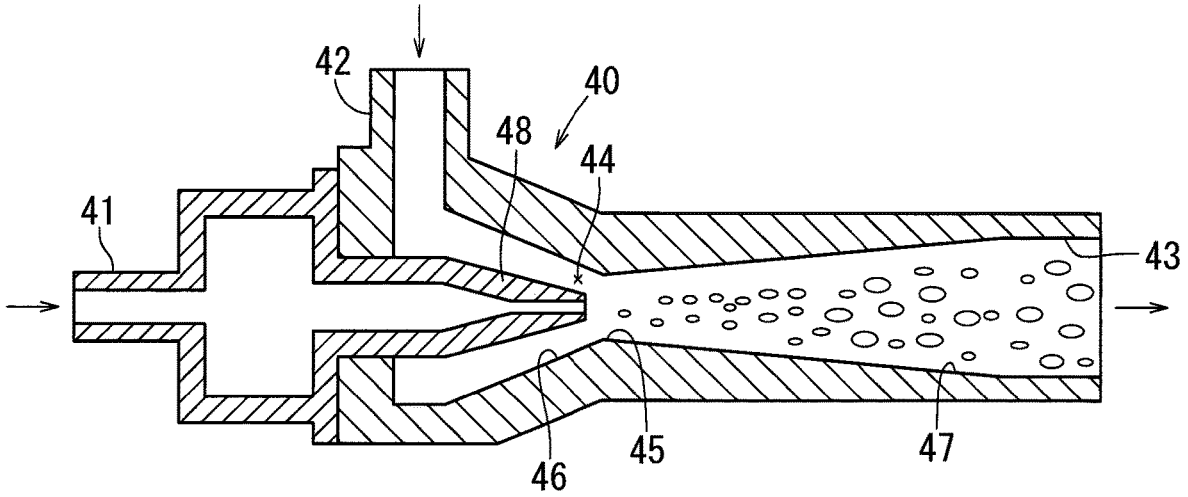
FIG. 3 is an enlarged cross-sectional view of the aspirator of FIG. 1.

As shown in FIGS. 1, a branch passage 52 branches from the fuel supply passage 56. The branch passage 52 supplies a portion of the high-pressure fuel delivered from the fuel pump to an aspirator 40. A branch passage valve 20 is provided along the branch passage 52. As shown in FIG. 3, the aspirator 40 includes a converging part 46, in which the flow path converges, and an expanding part (a diffuser) 47, in which the flow path expands. A constriction part 45 defines a narrow cross-sectional area of the flow path between the converging section 46 and the expanding part 47. The aspirator 40 is also provided with a nozzle 48 that injects fuel, which is introduced from an introduction port 41 into the expanding part 47.

A part of the fuel delivered from the fuel pump 8 is introduced into the aspirator 40 via the branch passage 52. The introduced fuel is injected at high velocity from the nozzle 48 through the converging part 46 toward the constriction part 45. At this time, a decompression space 44 around the fuel stream experiences a pressure drop and negative pressure due to the Venturi effect. The Venturi effect is caused by the reduction in the cross-sectional area of the fuel stream as it passes through the constriction part 45. A suction port 42 of the aspirator 40 is connected to and in fluid communication with the canister 4 via a suction passage 54. Accordingly, a suction force can be applied to the suction passage 54 and the canister 4, which are in fluid communication with the decompression space 44. The gas, for example the gas containing the fuel vapor from the canister 4, suctioned from the suction port 42 via the suction passage 54 passes through the expanding part 47 together with the fuel ejected from the nozzle 48. Then, the suctioned gas is returned to the fuel tank 2 via a discharge port 43.

The leakage detector shown in FIG. 1 include an electronic control unit (ECU) 60 that includes a processor and a memory. The ECU 60 is configured to receive data signals from sensors, such as the temperature sensor 22 and the pressure sensor 24. Further, the ECU 60 is configured to transmit control signals to valves, such as the sealing valve 12, the purge valve 14, the atmospheric valve 16, a shutoff valve 18, and the branch passage valve 20. The ECU 60 can also be configured to transmit a control sign to other devices, such as the fuel pump 8, so as to control the operation of those devices.

The process of leakage detection is performed by executing a program stored in the memory of the ECU 60. Leakage detection is started, for example, after the ECU detects that the engine has stopped (key-off). In one embodiment, for example, the detecting target area 30, which is an area to be monitored for leakage, may be a closed area that includes the fuel tank 2 and the canister 4. In this case, the ECU 60 closes the appropriate valves in order to close the detecting target area 30. For example, the purge valve 14 and the atmospheric valve 16 are closed; and the sealing valve 12, the shutoff valve 18, and the branch passage valve 20 are opened or are left open. In another embodiment, other detecting target areas 30 may be set up, such as a closed area that includes only the fuel tank 2 and not the canister 4, or only includes the canister 4. For example, it is also possible to divide the detecting target area 30 into an area on the canister side and an area on the tank side with regard to the sealing valve 12. This can be done by closing the atmospheric valve 16 and the sealing valve 12, and leaving open (or opening) the purge valve 14, the shutoff valve 18, and the branch passage valve 20.

Leakage detecting methods may be broadly classified into vapor pressure methods and pressure application methods. Leakage detection may be further classified into positive pressure methods and a negative pressure methods. For example, a vapor pressure method may be performed when the total pressure in the system, including the vapor pressure of fuel which exists naturally, is sufficiently positive or negative, an embodiment of which is described below, without active pressure application. On the other hand, a leakage detection according to a pressure application method may start with the forced introduction of a positive pressure or a negative pressure into the detecting target area 30. In some embodiments, "leakage" detection using a negative pressure method determines whether there is "infiltration" into the fuel vapor treatment system from the atmosphere. However, the purpose of this detection is to determine whether it is possible for fuel vapor to "leak out" into the atmosphere. Therefore, even when a negative pressure method is being used, the detection may be simply referred to as "leakage detection" in the present disclosure.

In order to perform the leakage detection using a pressure application method, the fuel vapor treatment system includes a device or means by which a positive pressure or a negative pressure can be applied to the fuel vapor treatment system. In an embodiment, by temporarily activating the aspirator 40, air may be drawn from the atmosphere through the suction passage 54 and introduced into the fuel tank 2, thereby applying a positive pressure. In this case, although not shown, the suction passage 54 may not be in communication with the canister 4, and may instead be open to the atmosphere in order to introduce air into the fuel tank 2. In another embodiment (also not shown), a purge pump, which forcibly sends air to the canister 4 during a purge operation of the canister 4, may be provided along the atmospheric passage 36. Thus, it is possible to introduce a positive pressure into the canister 4 and the fuel tank 2 by using the purge pump. As yet another embodiment, a vacuum pump configured to decompress the canister 4 can be provided along the atmospheric passage 36. The vacuum pump can be used to introduce a negative pressure into the canister 4 and the fuel tank 2. For example, the vacuum pump may be provided as a part of a modularized key-off pump module, along with the shutoff valve, for switching the communication state of the atmospheric passage 36. A pressure sensor for detecting the internal pressure in the canister 4 may also be included.

Figure 2:
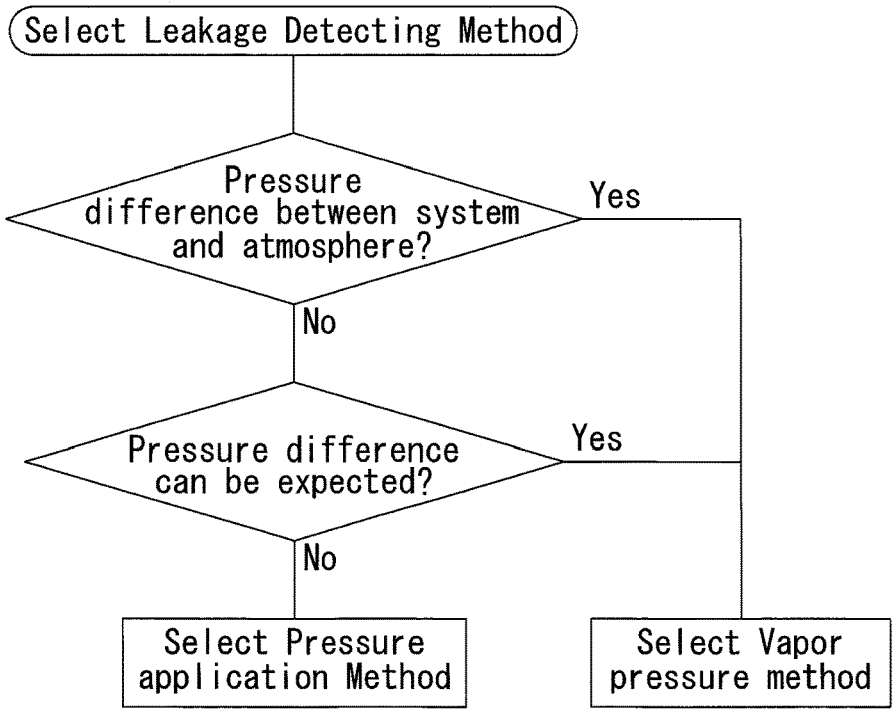
FIG. 2 is a flowchart illustrating an embodiment of a method for determining a leakage detecting method in accordance with the principles described herein.

As shown in FIG. 2, the ECU 60 starts a process for selecting the leakage detecting method to be used before performing the leakage detection.

Now an embodiment of Step 1 will be described below. First, the ECU 60 measures, for instance using the pressure sensor 24, the pressure in the detecting target area that is in contact with the gas-phase in the fuel tank 2. The difference between the measured pressure and the atmospheric pressure is calculated. Then, it is determined whether the predetermined conditions for performing leakage detection using a vapor pressure method are satisfied. In one embodiment, it is determined whether the absolute value of the difference between the pressure measured at a certain time t1 (i.e., P1) and atmospheric pressure (i.e., Patm) is equal to or greater than a predetermined reference pressure value (i.e., Pref). That is, it is determined whether $Pref \geq |P1-Patm|$. For example, if the measured pressure is greater than the atmospheric pressure by a predetermined value or more, it is determined that a detection using the positive vapor pressure method can be performed. Conversely, if the measured pressure is less than the atmospheric pressure by the predetermined value or more, it is determined that a detection using the negative vapor pressure method can be performed. The predetermined value, a criterion of, for example, a difference of 5 kPa from atmospheric pressure can be used for both of the positive pressure method and the negative pressure method. A standard (e.g., pre-stored) atmospheric pressure may be used for the atmospheric pressure Patm, or a measured value of the atmospheric pressure from an atmospheric pressure sensor provided at an appropriate place may be used.

In one embodiment, it is also possible to determine whether the absolute value of the difference between the measured pressure and the atmospheric pressure is both greater than the predetermined value (e.g., 5 kPa) and smaller than a second predetermined value. The second predetermined value being greater than the predetermined value. In this case, when it is determined that the absolute value of the pressure difference is greater than the atmospheric pressure by the second predetermined value, the leakage detector can determine that there is no leakage in the detecting target area without the need to perform either the vapor pressure method or the pressure application method, as described below. This decision is based on the presumption that the pressure should not be able to be held at or above the second predetermined value if there is leakage.

Figure 7:
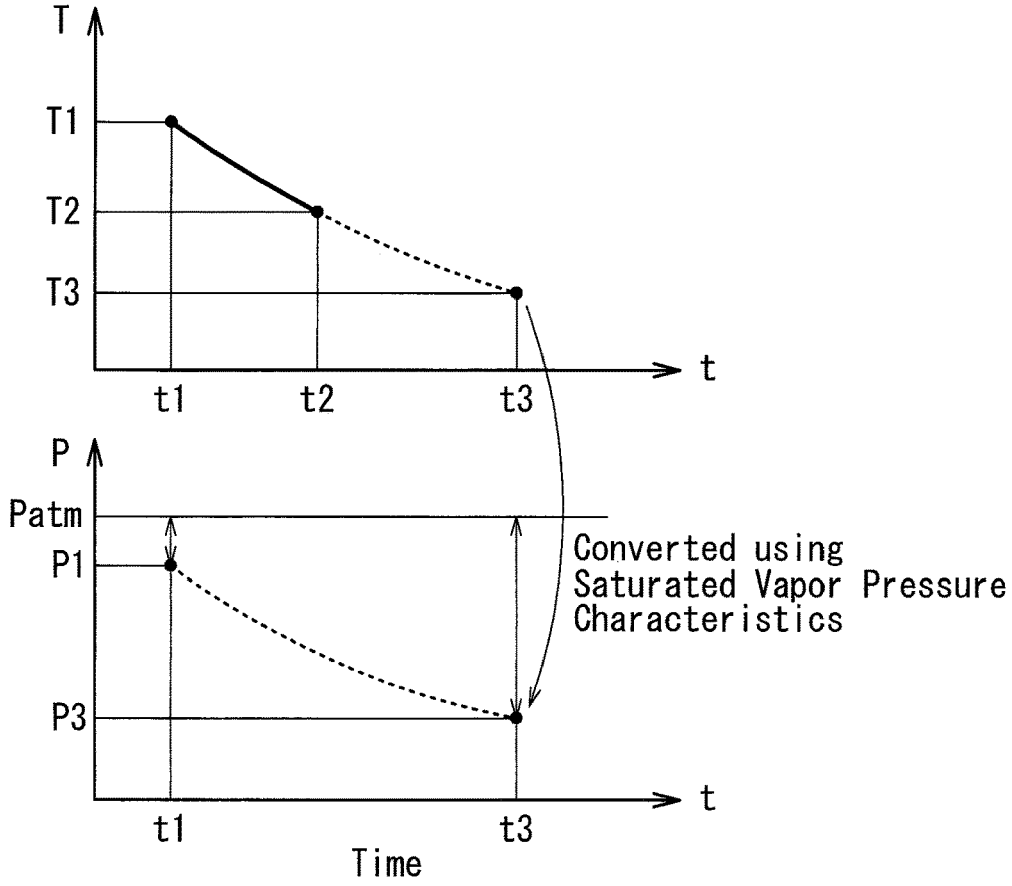
FIG. 7 is a graph illustrating how to estimate a future pressure change in the system from an estimated value of temperature change in the gas-phase.

Next, an embodiment of Step 2 will be described below. As shown in FIG. 2, the ECU 60 predicts whether the pressure in the detecting target area will satisfy the above-mentioned condition in the future due to temperature changes. Fuel has inherent saturated vapor pressure characteristics. As shown in FIG. 7, the vapor pressure (the fuel vapor partial pressure) changes in accordance with the temperature. For example, assuming that the fuel is in equilibrium between the gas-phase and the liquid-phase, it is possible to know the partial pressure of the fuel (both at that time and in the future) from the temperature and the saturated vapor pressure characteristics of the fuel. For instance, as shown in FIG. 7, the ECU 60 can estimate the time t3 at which the pressure in the detecting target area is expected to reach a predetermined pressure condition based on the predicted vapor pressure change. If such a time can be estimated, the ECU 60 may decide to select the vapor pressure method. If such a time can not be estimated and/or the pressure in the detecting target area is not expected to reach the predetermined pressure condition, the ECU 60 may decide to select the pressure application method.

In another embodiment, after the ECU 60 estimates the time t3 when the pressure in the detecting target area is expected to reach the predetermined condition based on the predicted vapor pressure change and after reaching the estimated time t3, it is also possible to confirm whether the pressure in the detecting target area has actually reached the predetermined condition by using a pressure sensor. The leakage detection may be performed only when it has been confirmed that the predetermined condition has been reached.

In another embodiment, after reaching the estimated time t3, the ECU 60 performs the leakage detection immediately, without first confirming whether the pressure satisfies the first predetermined condition.

It may be assumed that the saturated vapor pressure characteristic is constant, despite the type of fuel in the fuel tank 2. However, taking into consideration the case where the type of fuel to be refueled is different depending on the season and/or there may be a change in the fuel composition after refueling, the saturated vapor pressure characteristic of the fuel in the fuel tank 2 may be need to be specified (estimated). The process of determining the saturated vapor pressure characteristics can be performed at a convenient time, for example, immediately before each leakage detection, periodically, or immediately after refueling.

Figure 4:
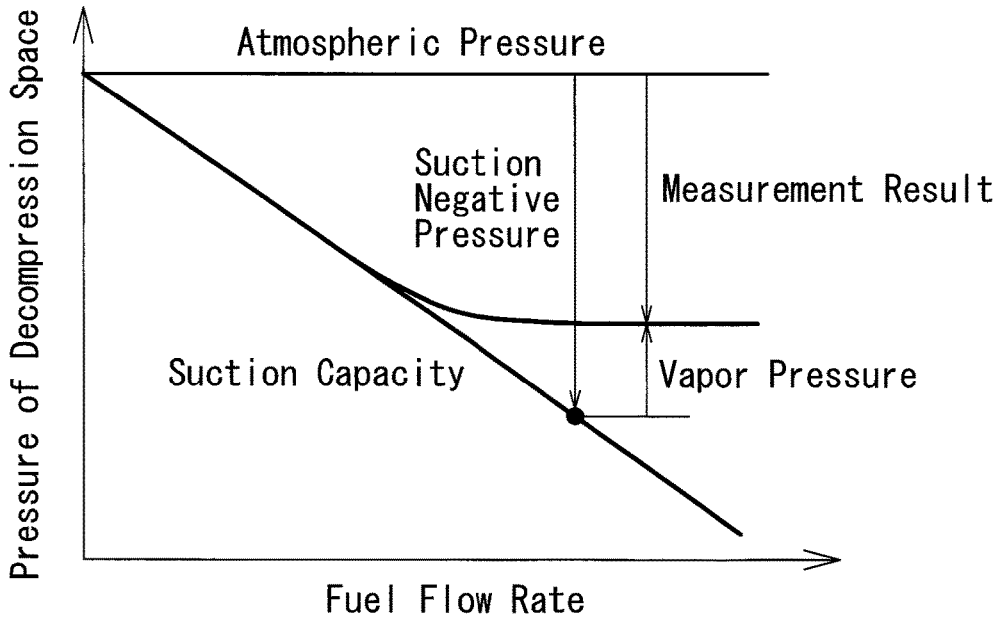
FIG. 4 is a diagram illustrating the pressure change in the decompression space with regard to a change in the fuel flow rate in the aspirator of FIG. 3.
Figure 5:
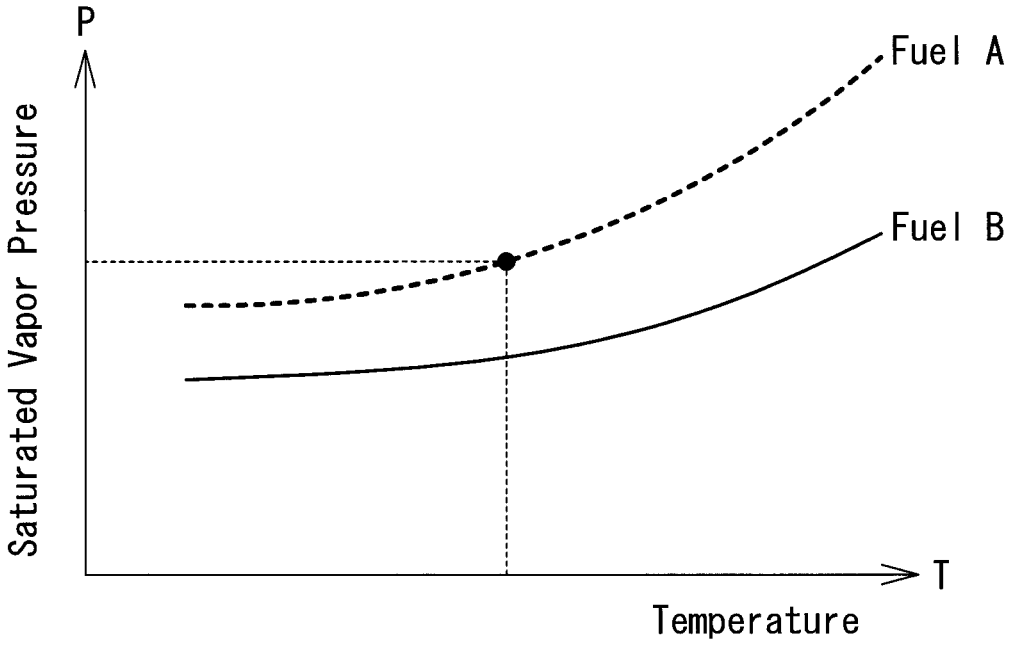
FIG. 5 is a graph including saturated vapor pressure curves and illustrating how to identify saturated vapor pressure characteristics based on temperature and pressure.

The saturated vapor pressure characteristics of various types of fuels used in engines (i.e., a curve or a map showing the change of saturated vapor pressure with respect to temperature, an example of which is shown in FIG. 5) are known. Therefore, the saturation vapor pressure characteristics can be stored in memory in advance. The estimation of the saturated vapor pressure characteristic of the fuel within the fuel tank 2 can be performed based on, for example, the pressure in the decompression space 44 of the aspirator 40. In one embodiment, a pressure sensor 26 is provided in a middle portion of the suction passage 54. The ECU 60 temporarily drives the aspirator 40 and measures the pressure in the suction passage 54 of the aspirator 40, for instance using the pressure sensor 26. In this embodiment, it is considered that the pressure in the suction passage 54 substantially matches the pressure in the decompression space 44. Further, the ECU 60 measures the temperature and pressure of the gas-phase in the fuel tank 2 by signals received from the temperature sensor 22 and the pressure sensor 24. In the state where the operation of the aspirator 40 is stable, it can be assumed that the fuel vapor in the decompression space 44 is saturated. In this stable state, as shown in FIG. 4, it can be considered that the measured pressure in the decompression space 44 is the sum of the anticipated negative pressure in the decompression space 44, for instance as calculated from the fuel supply amount of the fuel pump 8, and the saturated vapor pressure of the fuel. Therefore, the saturated vapor pressure of the fuel can be obtained by subtracting the anticipated negative pressure in the decompression space 44, as calculated from the fuel supply amount of the fuel pump 8, from the actual pressure measurement value of the decompression space 44. Generally, saturated vapor pressure characteristic curves for different fuel types do not intersect each other. Therefore, as shown in FIG. 5, the curve that matches the measured temperature and the calculated saturated vapor pressure can be identified as the saturated vapor pressure characteristic, from the plurality of stored saturated vapor pressure characteristic curves, of the specific fuel in the fuel tank 2. In another embodiment, the temperature of the decompression space 44 may be used instead of the temperature of the gas-phase in the fuel tank 2, the temperature of the decompression space 44 being measured by providing another temperature sensor in the suction passage 54 near the aspirator 40.

Figure 6:
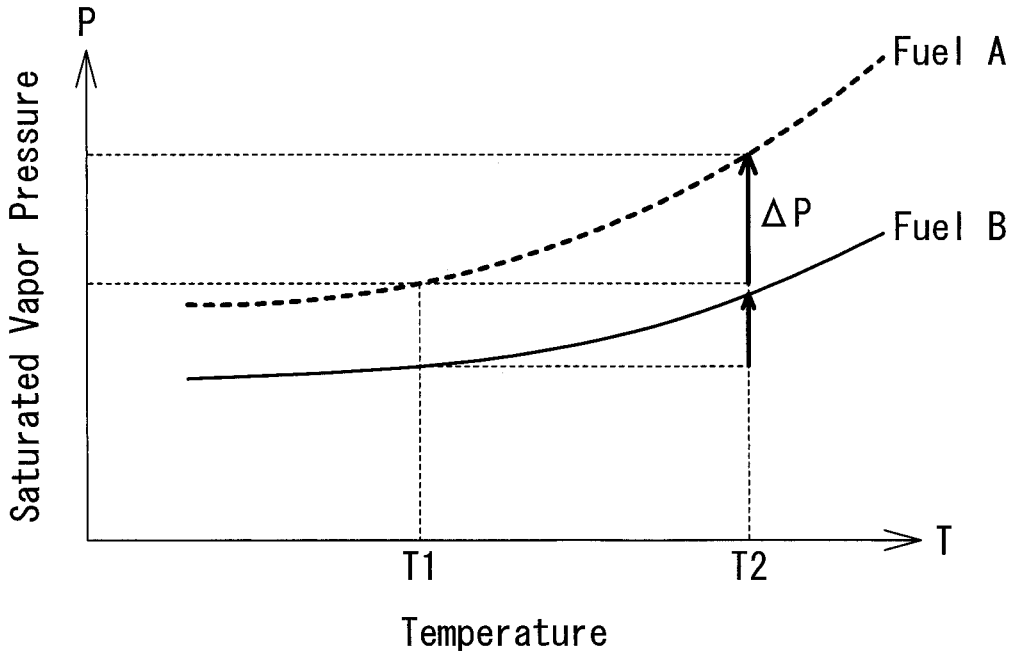
FIG. 6 is a graph including saturated vapor pressure curves and illustrating how to identify saturated vapor pressure characteristics based on a temperature change and a pressure change.

In another embodiment, it is also possible to determine the saturated vapor pressure characteristics of the fuel based on the pressure change of the gas-phase with respect to the temperature change of the gas-phase, for instance as shown in FIG. 6. For example, the pressure and temperature of the gas-phase in the fuel tank 2 are measured twice by the temperature sensor 22 and the pressure sensor 24. Then, a search is performed to determine which of a plurality of pre-stored saturated vapor pressure curves best matches the pressure change of the gas-phase ($\Delta$ P) with respect to the temperature change of the gas-phase (from T1 to T2), if any. The matched saturated vapor pressure curve (e.g., fuel A in the FIG. 6) is determined as the saturated vapor pressure characteristic of the fuel at that time.

Next, a prediction of the fuel vapor pressure change based on temperature will be described. In one embodiment, as shown in FIG. 7, a future fuel vapor temperature transition is predicted using a temperature history, e.g., multiple prior temperature measurement values (T1 and T2). When the detecting target area includes the fuel tank 2, the gas-phase in the fuel tank 2 can be provided with the temperature sensor 22. The temperature sensor 22 can be used to measure the gas-phase temperature multiple times, for instance at specific time intervals. For example, a first gas-phase temperature is measured when the engine is stopped (time t1), and a second gas-phase temperature is measured 30 minutes later (time t2). Fitting of an appropriate function, prepared in advance, is performed with respect to the obtained measured value of temperature. Thereby, a future temperature may be estimated. Alternatively, it is also possible to construct an appropriate heat conduction model between the gas-phase in the fuel tank 2 and the gas-phase in the fuel tank 2 or the atmosphere outside the fuel tank 2, and then calculate the future temperature according to the constructed heat conduction model. This type of method may be used, for example, for short-term predictions (e.g., minutes to tens of minutes ahead).

In another embodiment, it is also possible to accumulate data on changes in the gas-phase temperature over the course of a day. This accumulated data can then be used to infer a tendency of the gas-phase temperature. For example, it can be assumed that the gas-phase temperature is about the same around the same time of day. It can also be assumed that the temperature changes from a first time to a second time within one day are essentially equal regardless of the day. This type of method may be used, for example, for long-term predictions (e.g., one to two hours ahead).

In another embodiment, the ECU 60 indirectly estimates the gas-phase temperature in the fuel tank 2 from the liquid-phase (fuel) temperature in the fuel tank 2 and the atmospheric temperature outside the fuel tank 2. In this case, an outside-air temperature sensor 66 is provided at an appropriate place of the vehicle so that it may be in contact with the atmosphere. The fuel tank 2 also has a fuel temperature sensor 68 that is in contact with the liquid-phase of the fuel provided in the fuel tank 2. An intermediate value between the liquid-phase temperature and the atmospheric temperature, for example, an average value of the liquid-phase temperature and the atmospheric temperature, can be used as an estimated value of the gas-phase temperature in the fuel tank 2. However, it is also possible to use a value closer to either the liquid-phase temperature or the atmospheric temperature, rather than using the average value. This type of method is advantageous, for example, in reducing costs when there is no other need for a gas-phase temperature sensor 22 for the fuel tank 2.

Figure 8:
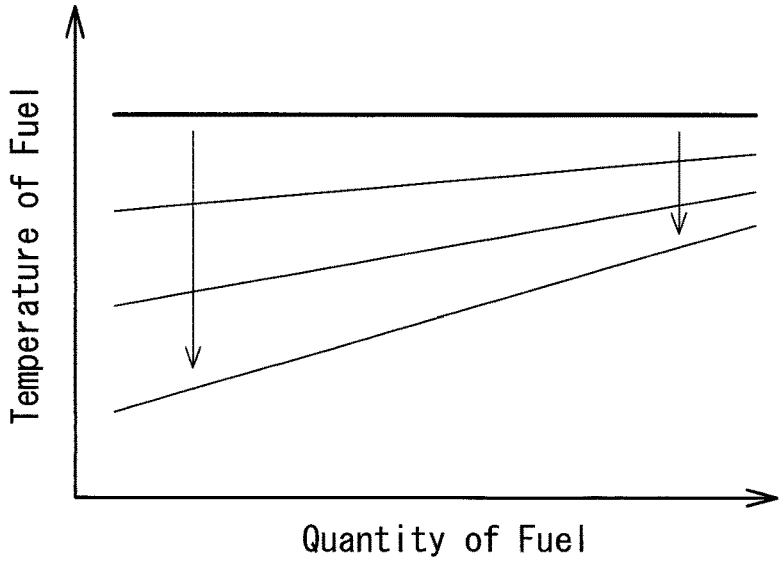
FIG. 8 is a graph illustrating that a rate of the temperature change of fuel depending on the fuel quantity.

As shown in FIG. 8, in one embodiment, it is assumed that the change in fuel temperature of the fuel in the fuel tank 2 depends on the amount of fuel. In other words, it may be assumed that when there is more fuel remaining in the fuel tank 2, the fuel temperature is less likely to drop, for instance due to its higher heat capacity. In this case, a fuel quantity sensor (not shown) can be provided in the fuel tank 2 to take this consideration into account.

As shown in FIG. 1, in another embodiment, the fuel temperature is estimated from an initial temperature and a subsequent temperature change trend in fluid temperature measured by a temperature sensor 64 provided in a flow path 62 of the engine coolant. After the engine 6 has stopped, the temperature of the engine coolant also decreases as the engine 6 cools. It is known that the temperature changes of the engine coolant at this time accurately reflects the trend of the heat changes of the entire vehicle as it cools down. Therefore, the temperature of the engine coolant can be used as an indicator of the temperature changes in the gas-phase in the fuel tank 2. In particular, in a system where some of the fuel sent to the engine 6 is recirculated to the fuel tank 2, the temperature of the engine coolant indicated by the temperature sensor when the engine 6 is stopped is considered to roughly match the fuel temperature of the fuel in the fuel tank 2.

The ECU 60 performs a leakage detection of a detecting target area (e.g., detecting target area 30) by the detection method determined to be the appropriate method as described above. The detection criteria for leakage detection in one embodiment is the pressure change that would occur when a hole of at least a predetermined size occurs somewhere in the fuel vapor treatment system, for example, in the fuel tank 2, the canister 4, or the conduit that forms the passage. In one embodiment, when the pressure measured by the pressure sensor 24 increases or decreases toward atmospheric pressure faster than a reference speed, it can be determined that there is a leakage. For example, in the case of a negative-pressure system, it is determined that there is a leakage when the confined negative pressure increases toward atmospheric pressure faster than a reference rate. In the case of a positive pressure system, it is determined that there is a leakage when the confined positive pressure decreases toward atmospheric pressure faster than a reference rate.

In another embodiment, it is possible to determine that there is a leakage if the rate of decrease in pressure, for instance as measured by the pressure sensor 24 during or after introducing a negative pressure into the detecting target area 30, is slower than a reference rate. The determination may be made in a similar manner when a positive pressure is introduced.

If it is determined that there is a leakage, the ECU 60 may, for example, turn on a warning light in the vehicle compartment when the engine 6 is operated. Accordingly, the driver may be informed that there is a leakage in the fuel vapor treatment system.

In another embodiment of a leakage detector for a fuel vapor treatment system, a controller is configured to estimate the time at which the pressure in the detecting target area satisfies a first predetermined condition based on the predicted vapor pressure change. This can be done if the vapor pressure change in the diagnostic target area 30 has been predicted. Accordingly, it becomes easy to judge the possibility of whether the detection may be made by the vapor pressure device.

In another embodiment of a leakage detector for a fuel vapor treatment system, the leakage detector further includes a pressure application device for applying a positive or negative pressure to the detecting target area of the fuel vapor treatment system. The controller can then confirm whether the pressure in the detecting target area satisfies a first predetermined condition, for instance by using a pressure sensor, after a predicted time has passed. When it has been confirmed that the first predetermined condition has been satisfied, a positive or negative pressure is applied to the confined detecting target area using the pressure application device. Thereby, the controller is configured to perform leakage detection based on a pressure change in the detecting target area. As a result, the possibility of failure of the leakage detection caused by an inability to use a vapor pressure device is reduced.

In another embodiment of a leakage detector for a fuel vapor treatment system, the leakage detector includes a pressure application device for applying positive or negative pressure to the detecting target area. A controller applies a positive or negative pressure to the confined detecting target area using the pressure application device. This may be done without first checking whether the pressure satisfies a first predetermined condition after a predicted time has passed. Then, the controller is configured to perform the leakage detection based on the pressure change in the detecting target area. Accordingly, the leakage detection using the vapor pressure device can be started as soon as possible.

In another embodiment of a leakage detector for a fuel vapor treatment system, a first predetermined condition is a condition in which the absolute value of the difference between a pressure in a detecting target area and atmospheric pressure is greater than a predetermined value. Using this condition, it is possible to quickly determine the conditions to be detected by the vapor pressure device.

In another embodiment of a leakage detector for a fuel vapor treatment system, a fuel tank includes a temperature sensor for detecting the temperature of a gas-phase of the fuel tank. A controller measures the temperature of the gas-phase multiple times using the temperature sensor. Then, the controller is configured to predict vapor pressure change based on the change of the measured temperature of the gas-phase. Accordingly, it is possible to accurately estimate short-term changes in vapor pressure.

In another embodiment of a leakage detector for a fuel vapor treatment system, a fuel tank includes a temperature sensor for detecting the temperature of the gas-phase of the fuel tank. A controller obtains the temperature transition of the gas-phase over the course of a day from multiple temperature readings of the gas-phase as measured by the temperature sensor. Then, the controller is configured to predict a vapor pressure change based on the obtained temperature transition. Accordingly, it is possible to easily estimate long-term changes in vapor pressure.

In another embodiment of a leakage detector for a fuel vapor treatment system, the fuel vapor treatment system includes a fuel temperature sensor, an outside air temperature sensor, and a fuel quantity sensor. The fuel temperature sensor detects the temperature of the fuel in the fuel tank. The outside air temperature sensor detects the temperature of the outside atmosphere. The fuel quantity sensor detects the remaining amount of fuel in the fuel tank. A controller is configured to predict a vapor pressure change based on the fuel temperature measured by the fuel temperature sensor, the outside air temperature measured by the outside air temperature sensor, and the fuel quantity measured by the fuel quantity sensor. Accordingly, a sensor that measures the temperature of the gas-phase of the fuel tank may be omitted.

In another embodiment of a leakage detector for a fuel vapor treatment system, a fuel tank includes a temperature sensor for detecting the temperature of the gas-phase of the fuel tank. A controller is configured to determine the saturated vapor pressure characteristics of the fuel in the fuel tank based on the temperature of the gas-phase as measured by the temperature sensor. Accordingly, the dependence of saturated vapor pressure characteristics on fuel composition can be taken into account, and the leakage detection method may be determined more precisely.

In another embodiment of a leakage detector for a fuel vapor treatment system, a controller is configured to perform leakage detection by a second method without first predicting a change in vapor pressure. This can be done when it has been determined that the leakage detection by the first method is to be performed. Accordingly, it is possible to omit the process of applying pressure and reduce power consumption.

In another embodiment of a leakage detector for a fuel vapor treatment system, a first predetermined condition is a condition in which the absolute value of the difference between a pressure in a detecting target area and atmospheric pressure is above a predetermined value and below a second predetermined value. If a controller determines that the absolute value of the difference between the pressure in the detecting target area and atmospheric pressure is greater than the second predetermined value, the controller is configured to determine that there is no leakage without first predicting a vapor pressure change. As a result, it is possible to avoid unnecessary detection.

The various examples described above in detail with reference to the attached drawings are intended to be representative of the present disclosure, and are thus non-limiting embodiments. The detailed description is intended to teach a person of skill in the art to make, use, and/or practice various aspects of the present teachings, and thus does not limit the scope of the disclosure in any manner. Furthermore, each of the additional features and teachings disclosed above may be applied and/or used separately or with other features and teachings in any combination thereof, to provide an improved leakage detector for fuel vapor treatment system, and/or methods of making and using the same.

What is claimed is:

1. A leakage detector for detecting a leakage of fuel vapor from a fuel vapor treatment system having a fuel tank, leakage detector comprising:

a pressure sensor configured to detect a pressure in a detecting target area of the fuel vapor treatment system; and a controller, wherein the controller is configured to:

measure the pressure in the detecting target area at a first time using the pressure sensor;

determine whether the measured pressure in the detecting target area satisfies a first predetermined condition for leakage detection by a first method, wherein the first method does not include a forced pressure application;

determine that leakage detection by the first method is to be performed if the controller has determined that the first predetermined condition has been satisfied;

predict a change in vapor pressure in the detecting target area due to a change in temperature to a subsequent temperature based on a saturated vapor pressure characteristic of fuel in the fuel tank when the controller has determined that the first predetermined condition has not been satisfied; and determine that leakage detection by a second method that includes a forced pressure application is to be performed when it has been determined that a predicted vapor pressure in the detecting target area would not continuously satisfy the first predetermined condition based on the predicted change in vapor pressure.

2. The leakage detector for the fuel vapor treatment system of claim 1, wherein the controller is further configured to estimate a time at which the pressure in the detecting target area is expected to satisfy the first predetermined condition based on the predicted the change in vapor pressure when the controller has been predicted the change in vapor pressure in the detecting target area.

3. The leakage detector for the fuel vapor treatment system of claim 2, further comprising a pressure application device configured to apply a positive or negative pressure to the detecting target area of the fuel vapor treatment system, wherein the controller is further configured to:

determine whether the pressure in the detecting target area satisfies the first predetermined condition by the pressure sensor after the estimated time has passed;

determine that leakage detection by the first method is to be performed if the controller has determined that the first predetermined condition has been satisfied;

determine that leakage detection by the second method is to be performed if the controller has determined that the first predetermined condition has not been satisfied and instruct the pressure application device to apply the positive or negative pressure to the detecting target area; and perform the leakage detection by the determined method based on a detected change in pressure in the detecting target area.

4. The leakage detector for the fuel vapor treatment system of claim 2, wherein the controller is further configured to perform the leakage detection by the first method based on a pressure change in the detecting target area without determining whether the pressure satisfies the first predetermined condition after the estimated time has passed.

5. The leakage detector for the fuel vapor treatment system of claim 1, wherein the first predetermined condition is a condition in which the absolute value of the difference between the pressure in the detecting target area and atmospheric pressure is greater than a predetermined value.

6. The leakage detector for the fuel vapor treatment system of claim 1, further comprising a temperature sensor for detecting the temperature of the gas-phase, wherein the controller is further configured to:

measure the temperature of the gas-phase multiple times using the temperature sensor; and predict the change in vapor pressure based on the change of the measured temperature of the gas-phase.

7. The leakage detector for the fuel vapor treatment system according to claim 1, further comprising a temperature sensor configured to detect the temperature of the gas-phase, wherein the controller is further configured to:

obtain a temperature transition curve of the gas-phase over a course of a day from multiple gas-phase temperature measurements using the temperature sensor; and predict the change in vapor pressure based on the obtained temperature transition curve.

8. The leakage detector for the fuel vapor treatment system of claim 1, further comprising:

a fuel temperature sensor configured to detect the temperature of the fuel in the fuel tank;

an outside air temperature sensor configured to detect the temperature of outside air; and a fuel quantity sensor configured to detect an amount of fuel remaining in the fuel tank, wherein the controller is further configured to predict the change in vapor pressure based on the fuel temperature measured by the fuel temperature sensor, the outside air temperature measured by the outside air temperature sensor, and the fuel quantity measured by the fuel quantity sensor.

9. The leakage detector for the fuel vapor treatment system of claim 1, further comprising a temperature sensor configured to detect the temperature of the gas-phase, wherein the controller is further configured to determine the saturated vapor pressure characteristics of the fuel in the fuel tank based on the temperature of the gas-phase measured by the temperature sensor.

10. The leakage detector for the fuel vapor treatment system of claim 1, wherein, if it has been determined that the first predetermined condition has been satisfied and the leakage detection will be performed by the first method, the controller is further configured to perform the leakage detection by the first method without predicting the change in vapor pressure based on a pressure change in the detecting target area.

11. The leakage detector for the fuel vapor treatment system of claim 1, wherein;

the first predetermined condition is a condition in which the absolute value of the difference between the pressure in the detecting target area and atmospheric pressure is above a first predetermined value and is below a second predetermined value, and if the controller determines the absolute value of the difference between the pressure in the detecting target area and atmospheric pressure is greater than the second value, the controller is configured to determine that there is no leakage without predicting the change in vapor pressure.

* * * * *